US010267327B2

(12) United States Patent
Chien et al.

(10) Patent No.: US 10,267,327 B2
(45) Date of Patent: Apr. 23, 2019

(54) MAGNETIC DRIVE PUMP

(71) Applicant: ASSOMA INC., Taoyuan (TW)

(72) Inventors: Huan-Jan Chien, Hsinchu County (TW); Chin-Cheng Wang, Yilan County (TW); Chih-Hsien Shih, Taoyuan (TW); Chih-Kuan Shih, Taoyuan (TW)

(73) Assignee: ASSOMA INC., Taoyuan (TW)

( * ) Notice: Subject to any disclaimer, the term of this patent is extended or adjusted under 35 U.S.C. 154(b) by 61 days.

(21) Appl. No.: 15/582,744

(22) Filed: Apr. 30, 2017

(65) Prior Publication Data

US 2017/0234326 A1 Aug. 17, 2017

Related U.S. Application Data

(62) Division of application No. 13/657,563, filed on Oct. 22, 2012, now Pat. No. 9,670,934.

(30) Foreign Application Priority Data

Nov. 3, 2011 (TW) ..... 100140138 A

(51) Int. Cl.
*F04D 29/42* (2006.01)
*F04D 29/043* (2006.01)
(Continued)

(52) U.S. Cl.
CPC ..... *F04D 29/0473* (2013.01); *F04D 13/026* (2013.01); *F04D 13/06* (2013.01);
(Continued)

(58) Field of Classification Search
CPC ..... F04D 13/026; F04D 29/628; F04D 13/06; F04D 29/026; F04D 29/043;
(Continued)

(56) References Cited

U.S. PATENT DOCUMENTS 4,722,661 A * 2/1988 Mizuno ..... F04D 13/026 310/106
4,812,108 A * 3/1989 Kotera ..... F04D 29/0413 415/111
(Continued)

FOREIGN PATENT DOCUMENTS

CN 2482597 Y 3/2002
JP S62-148795 U 9/1987
(Continued)

*Primary Examiner* — Dominick L Plakkoottam
(74) *Attorney, Agent, or Firm* — Maschoff Brennan

(57) ABSTRACT

A sealless magnetic drive pump features in improving the stiffness of a stationary shaft. More particularly, the metal magnetic drive pump has an anti-corrosion casing liner. The magnetic drive pump is used in manufacture processes related to corrosive fluid. The pump is especially used in a highly corrosive and high-temperature (up to 200° C.) condition to improve the stiffness of a front support. The stationary shaft includes a metal front support integrated with the pump casing at a pump inlet and encapsulated with a resin enclosure made of a fluoropolymer; a rear shaft seat positioned on a sealed bottom side of a containment shell for offering auxiliary support for the stationary shaft; an impeller including a channel for reducing an inlet flow velocity to offer a low NPSHr.

5 Claims, 9 Drawing Sheets

(51) Int. Cl.

| | |
|---|---|
| ***F04D 29/02*** | (2006.01) |
| ***F04D 29/22*** | (2006.01) |
| ***F04D 29/62*** | (2006.01) |
| ***F04D 13/06*** | (2006.01) |
| ***F04D 29/10*** | (2006.01) |
| ***F04D 29/047*** | (2006.01) |
| ***F04D 29/041*** | (2006.01) |
| ***F04D 29/06*** | (2006.01) |
| ***F04D 13/02*** | (2006.01) |

(52) U.S. Cl.
CPC ..... *F04D 29/026* (2013.01); *F04D 29/043* (2013.01); *F04D 29/047* (2013.01); *F04D 29/0413* (2013.01); *F04D 29/061* (2013.01); *F04D 29/106* (2013.01); *F04D 29/22* (2013.01); *F04D 29/4273* (2013.01); *F04D 29/4286* (2013.01); *F04D 29/4293* (2013.01); *F04D 29/628* (2013.01)

(58) Field of Classification Search
CPC .. F04D 29/0465; F04D 29/047; F04D 29/061; F04D 29/106; F04D 29/22; F04D 29/4286; F04D 29/4293; F04D 13/025; F04D 29/0473
See application file for complete search history.

(56) References Cited

U.S. PATENT DOCUMENTS

| | | | | |
|---|---|---|---|---|
| 4,850,818 | A | 7/1989 | Kotera | |
| 5,895,203 | A | 4/1999 | Klein | |
| 6,234,748 | B1 * | 5/2001 | Brown | F04D 29/0413 415/170.1 |
| 6,280,156 | B1 | 8/2001 | Wirz et al. | |
| 6,293,772 | B1 | 9/2001 | Brown et al. | |
| 6,443,710 | B1 * | 9/2002 | Tatsukami | F04D 29/0413 417/365 |
| 7,033,146 | B2 | 4/2006 | Shi | |
| 7,057,320 | B2 * | 6/2006 | Abordi | H02K 1/278 310/103 |
| 7,101,158 | B2 | 9/2006 | Hembree et al. | |
| 7,249,939 | B2 | 7/2007 | Yanagihara et al. | |
| 2010/0028176 | A1 * | 2/2010 | Platt | F04D 29/048 417/420 |
| 2017/0234326 | A1 * | 8/2017 | Chien | F04D 29/0473 417/423.1 |
| 2017/0234327 | A1 * | 8/2017 | Chien | F04D 29/0473 417/423.1 |

FOREIGN PATENT DOCUMENTS

| | | | |
|---|---|---|---|
| JP | S63-52990 | U | 4/1988 |
| JP | H02-76191 | U | 6/1990 |
| JP | H08-277795 | A | 10/1996 |

* cited by examiner

MAGNETIC DRIVE PUMP

CROSS-REFERENCE TO RELATED APPLICATIONS

This patent application is a divisional patent application of U.S. patent application Ser. No. 13/657,563 filed on Oct. 22, 2012 and entitled "MAGNETIC DRIVE PUMP", which is a non-provisional application claims priority under 35 U.S.C. § 119(a) on Patent Application No(s). 100140138 filed in Taiwan, R.O.C. on Nov. 3, 2011, the entire contents of which are hereby incorporated by reference.

BACKGROUND

Technical Field

The invention relates to a magnetic drive pump, and more particularly to, a magnetic drive pump including a stationary shaft, and a metal pump casing with an anti-corrosion casing liner, in order to make the magnetic drive pump operate reliably at 200 degrees Celsius (° C.), and meet a high performance requirement for the magnetic drive pump when transferring fluid. Moreover, a one-piece casing with a stationary shaft supporting structure and a flow channel structure thereof, are improved for enhancing the supporting stiffness of the stationary shaft to reduce the temperature impact on a fluoropolymer component structure and for enhancing the performance, the reliability and life cycle of the magnetic drive pump.

Related Art

A sealless magnetic drive pump known to the skilled in the art is generally adopted for anti-corrosion or leakage prevention. In structure design, the magnetic drive pump includes either a stationary shaft or a rotary shaft. The supporting method for the stationary shaft includes a double-sided-supporting or a cantilever supporting structure, and the material of the stationary shaft support of the magnetic drive pump with stationary shaft is plastic material or a reinforced plastic material with metal; a front end and a rear end of the stationary shaft are supported by a triangle front support made of plastic and a sealed rear shaft seat of a containment shell, respectively. A fiber reinforce structure covers a bottom side of the containment shell. The stiffness of the plastic is decreased when the operating temperature rises as well as the stiffness of the triangle front support and that of the rear shaft seat are decreased accordingly, which makes the stationary shaft crooked and moved. The cantilever support at the rear end of the stationary shaft is supported by the metal-reinforce bottom side of the containment shell, the supporting stiffness comes from a radial force which is applied on the cantilever stationary shaft and spread to the containment shell, thereby reducing the deformation of the containment shell and enhancing the handling of the stationary shaft. However, the stiffness is limited by the temperature of the fiber reinforce plastic of the containment shell; the following prior arts further describes the problems and the potential problems about the stationary shaft of the magnetic drive pump.

Case 1:

U.S. Pat. No. 7,033,146: Sealed magnetic drive sealless pump, 2006. This patent describes a bearing design for dry-run condition. Figures in the invention indeed describes a conventional double-sided stationary shaft of the plastic magnetic drive pump and a triangle front support which is installed in the inner space of an inlet and extends axially through a hub aperture. A front shaft seat is positioned on the rear end of the triangle front support and on the inner side of the hub aperture for supporting one end of the stationary shaft. The patent tries to reduce the flow resistance of an inlet channel as much as possible by the triangle front support. The containment shell is a cup-shaped shell structure, and a rear shaft seat without any through hole is positioned on a bottom side of the containment shell for supporting the other end of the stationary shaft. The stiffness of the triangle front support and that of the containment shell are easily reduced because of increased temperature. As shown in the figure, in order to reduce the impact on the inlet channel by the triangle front support, the length of the triangle front support is deliberately extended so that front shaft seat passes through the hub aperture. But such a structure may reduce the strength of the triangle front support in the radial direction and should only be adopted in a device with lower power at low temperature.

Case 2:

U.S. Pat. No. 7,057,320: Mechanical drive system operating by magnetic force, 2006. This patent describes the structure and the design of an out rotor of a magnetic drive pump, and the figure of the invention distinctly shows a conventional double-sided-supported stationary shaft of a magnetic drive pump, and a triangle front support which is positioned in the inner space of an inlet and integrates with a pump casing in one piece by injection molding. The triangle front support extends axially towards the vicinity of an inlet of the impeller blade. A front thrust ring is installed on an end surface of a front shaft seat of the triangle front support, and a thrust bearing is installed on a hub plate and protrudes toward the inlet of the impeller. The containment shell is a cup-shaped shell structure, and a rear shaft seat without any through hole is positioned on a bottom side of the containment shell for supporting the other end of the stationary shaft. In order to reduce the flow resistance of the inlet channel from the front shaft seat of the triangle front support and the thrust ring, the diameter of the inlet of the impeller is increased to be greater than the inner diameter of the inlet of the pump so that the flow resistance may be reduced. But, the hub plate of the impeller and the front shaft seat are not in a smooth surface, and therefore it will interfere the flow at the leading edge of the impeller, and the lower flow resistance advantage is reduced.

Case 3:

CN Patent number CN2482597Y, Magnetic drive corrosion resistant fluoropolymer liner pump, 2002. The patent discloses a magnetic drive pump including a metal pump casing with a casing liner and describes the structure of the casing liner made of fluoropolymer and its use in corrosion resistance. The magnetic drive pump includes a shaft support integrated with the casing liner as one piece, wherein the casing liner is made of fluoropolymer. The containment shell made of fluoropolymer is a cup-shaped shell structure, and a rear shaft seat without any through hole is positioned on a bottom side of the containment shell for supporting the other end of the stationary shaft. However, the invention indicates that the supporting structure of the double-sided-supported stationary shaft which is made of fluoropolymer may be elastically deformed, and the vibration of the shaft may be eased when the pump operates. But the invention does not further describe whether the stiffness and the reliability of the structure may be applied up to a high temperature of 200° C.

Case 4:

U.S. Pat. No. 5,895,203: Centrifugal pump having separable multipartite impeller assembly, 1999. The patent discloses a magnetic drive pump including a metal pump casing with a plastic casing liner and a double-sided-supporting stationary shaft structure. A separable triangle front support is installed in the inner-diameter space of an inlet by an outer ring fitted in the inner ring surface of the inlet. A front shaft seat which is positioned at the center of the shaft support is used for offering the front-end support for a stationary shaft. The patent emphasizes the triangle front support including reinforcing material encapsulated within anti-corrosion material for enhancing the endurance of the front-end support of the stationary shaft when the triangle front support is subjected to force or vibration. Moreover, the patent further emphasizes that the diameter of the front end of the stationary shaft must be less than that of the rear end of the stationary shaft so that the outer diameter of the front shaft seat of the triangle front support may be reduced, and the surface of the nose is made into a smooth curve surface to meet with flowing requirement. When the front side of the stationary shaft is installed in the inlet of the pump, the resistance of the flow into the impeller may be reduced.

Case 5:

U.S. Pat. No. 6,280,156B1: Magnetically coupled rotary pump, 2001. The patent discloses an out-rotor type magnetic drive pump. The patent emphasizes that the vertical magnetic drive pump made of metal without plastic liner can drainage transferred fluid completely during maintenance. A stationary shaft is supported by a single-sided-supporting structure at the pump inlet which consists of a triangle front support and a cone-shaped front shaft seat. The triangle front support and the cone-shaped front shaft seat are formed onto or fixed on a metal pump casing. The cone-shaped front shaft seat is positioned in the inner space of the pump inlet so the inner diameter of the pump inlet must be increased to accommodate blockage of the cone-shaped front shaft seat and preserve essential space of the flow channel; a bearing of the impeller is installed in the inner space of an hub part axially extending towards the inlet and is used for mating with a sleeve at the rear end of the cone-shaped front shaft seat, and with a thrust ring. Thus, a curve surface of the cone-shaped front shaft seat which is gradually increased in an oblique direction may be connected to a curve surface of the axial hub part of the impeller smoothly, and furthermore the inlet of the impeller adopts a large-caliber design corresponding to the outer diameter of the axial hub part. Therefore, the case is feasible; but if the structure is to be adapted for highly anti-corrosion application, for example, hydrofluoric acid, then the metal pump casing must be made with a fluoropolymer liner, and the internal structure surface of the metal pump casing must be encapsulted with fluoropolymer, and the impeller must be made of fluoropolymer with metal reinforced. The minimum thickness of the liner and encapsulations must be at least 3 millimeters (mm), so the additional increase of the outer diameter of the cone-shaped front shaft seat will be twice of the 3 mm requirement. Similar increases apply to all other parts that are lined or encapsulated. If structural strength of the fluoropolymer is to be considered, the liner or encapsulation needs to be thicker. A metal reinforce plate is further installed in a hub plate of the impeller made of fluoropolymer, and comprises the axially extending axial hub part of the impeller for enhancing the structural strength and moment transmission, and furthermore a bearing which is installed in the inner space of the axial hub part is replaced by a ceramic bearing whose thickness is similar to that of the sleeve. Moreover, the inner diameter and outer diameter of the axial hub part are greatly increased because of the addition of the metal reinforce plate, the double-sided resin enclosure and the ceramic bearing. If only the cone-shaped front shaft seat is covered with the resin enclosure, the outer diameter of a cone curve surface must be increased accordingly, but is still much less than the outer diameter of the axial hub part with encapsulated liner, thus, the slope of a metal part of the cone-shaped front shaft seat must be adjusted by increasing its outer diameter to be smoothly connected to the curve surface of the axial hub part of the impeller. That is to say, the cylindrical inner surface in the inner space of the pump inlet must has greater expanding angle to meet with the curve surface of the cone-shaped front shaft seat and the outer diameter of the axial hub part. Therefore, the inlet of the impeller which has been adopted the large-caliber design must increase its size further, and fluid in the inlet of the pump must flow to the inlet of the impeller through a shorter axial distance and in the greater expanding angle. Regarding to such limitations, the metal pump having low flow resistance property may not be obtained and the design of the impeller is much more difficult; Another problem of the fluoropolymer impeller is that when the weight of the impeller is greatly reduced, the centroid of a rotor system formed of the rotor and the impeller is moved to the magnetic rotor side, that is, the rear end of the impeller, but the ceramic bearing is installed in the inner space of the axial hub part, that is, the length and the position of the ceramic bearing is not consistent with the centroid of the rotor system so that the weight of the rotor system may cause a big moment applying on ceramic bearing, and the lifecycle of the pump may not be ensured.

Case 6:

U.S. Pat. No. 7,101,158B2: Hydraulic balancing magnetically driven centrifugal pump, 2001. The invention describes a problem of an axial thrust balance of a magnetic drive pump. The figure in the invention distinctly shows that when the diameter of a stationary shaft is fixed and a triangle front support is assembled in the inner space of an inlet, the excess outer diameter of a front shaft seat of the triangle front support affects an inlet channel of an impeller and reduces the performance of the pump. Therefore, the inner diameter of an inlet channel of the pump must be increased to reduce the flow resistance of the inlet of the impeller.

Case 7:

U.S. Pat. No. 7,249,939B2: Rear casing arrangement for magnetic drive pump, 2007. The invention discloses a magnetic drive pump including a stationary shaft with a double-sided-support or a rotary shaft. The invention indicates that the strength of a containment shell of the magnetic drive pump is a problem which needs to be further concerned about. The gap of an out rotor and an inner rotor is narrow and limited, and plastic material with high corrosion resistance is usually thermoplastic, so the strength of the plastic material is reduced with increasing temperature. In prior art, a second reinforce layer is installed on the outer surface of the anti-corrosion layer of the containment shell. In this patent, a nonmetallic banding circular reinforce component is installed between two layer structures or on the outer surfaces of the two layer structures which are on a lateral cylindrical portion so that the strength of a lateral shell column part of the containment shell is enhanced. This method is better than the conventional method enabling a fiber stripe to wind up around the circumference into multiple layers. But this method may not effectively overcome the bending deformation of the shell column part due to a radial force applying to a rear shaft seat of the containment shell, and furthermore the invention also indirectly confirms that the supporting of the stationary shaft is affected by the strength of the shell column part of the containment shell.

Case 8:

U.S. Pat. No. 6,293,772B1: Containment member for a magnetic-drive centrifugal pump, 2001. The patent is applied to a metal magnetic drive pump including an anti-corrosion casing liner, and distinctly indicates that the strength of a plastic triangle front support of the magnetic drive pump and that of a containment shell of the magnetic drive pump both need to be further concerned. The triangle front support often affects an inlet channel of an impeller so that the performance of the pump is reduced. The strength of the containment shell not only resists fluid pressure but also offers the support for a stationary shaft. The invention is that a disc-shaped metal reinforce component is embedded between a inner layer and a outer layer structure at a bottom side of the containment shell, a radial force which applies to the cantilever stationary shaft may evenly transmit to a shell column part of the containment shell, and furthermore the reinforce component includes an extending portion having smaller diameter and extending inwardly in an axial direction for enhancing the support and the handling of the stationary shaft, so that the strength of the containment shell may support the stationary shaft in a cantilever way. Therefore, the cantilever stationary shaft without the triangle front support help meet lower NPSHr requirement, and has sufficient strength. However, the invention does not distinctly describe the strength of the lateral shell column part of the containment shell for preventing the stationary shaft from un-positioned after the reinforcement.

To sum up, as for the magnetic drive pump including the pump parts only made of fluoropolymer or the parts with fluoropolymer liner, the problem of the structure and the strength of the stationary shaft are shown as follows:

1. The weakness of the strength of the fluoropolymer material.
2. The stiffness requirement for the supporting structure of the stationary shaft.
3. The flow resistance problem of the inlet channel.
4. The problem of Net Positive Suction Head required (NPSHr) of the inlet channel of the impeller.
5. The strength problem of the containment shell including its shell column part and its bottom part.

However, each of the solutions in the above-mentioned patents may not meet the requirement that the stationary shaft with high stiffness may transfer the fluid at high temperature, 200° C. In order to solve the above-mentioned problem, a magnetic drive pump is disclosed in this invention. The following is the detailed description of the present invention:

SUMMARY

The invention relates to a magnetic drive pump, and more particularly to, a reinforce structure of a stationary shaft with front end and rear end supports. The components of the magnetic drive pump are commonly covered with a casing liner or a resin enclosure which are made of fluoropolymer. The so-called fluoropolymer may be perfluoroalkoxy (PFA), ethylene tetrafluoroethylene (ETFE), which inherit some mechanical properties of the components, such as high extensibility and high compressibility. These components include a pump casing, an impeller and a containment shell. The melting point of fluoropolymer is above 300° C. but the strength of the fluoropolymers is gradually reduced with increasing temperature. Therefore, the invention uses the structure stiffness of a pump casing made of cast iron or stainless steel to compensate for the strength requirement of the fluoropolymer components so that the pump may operate with high reliability at temperatures up to 200° C. A high stiffness inlet front support shall provide ample supporting stiffness for the stationary shaft. In order to meet the support requirement of the stationary shaft, the front support and, inlet, volute, and impeller channels, are designed integrally for obtaining the highly stiff supporting of the stationary shaft, and greatly reducing the flow resistance of the inlet channel generated by the front support. The containment shell of the pump is used for sealing without leakage, temperature resistance and pressure resistance, and offers auxiliary support for an end of the stationary shaft.

The front support includes two rib plates made of cast iron or stainless steel and extending axially toward the inside of the pump casing. The rib plates extend inward from an inner surface of an inlet of the pump casing and combine together at the center of the inner diameter, combining into a right angle structure where the two ribs are perpendicular to each other. In the following paragraphs, all of the front supports have the feature of right angle structure. A cone body is formed at the combination of the two ribs plates and the center of the cone body corresponds to the center of the inner diameter. The cone body extends inwardly towards the rear side of the pump casing. A front shaft seat is positioned at the rear end of the front support. The rib plates extend axially according to the axial length of the cone body and the width of the rib plates is gradually reduced to match with the outer diameter of the front shaft seat, the front shaft seat passes through a hub aperture and an arc of the front shaft seat forms a smooth curve surface with a hub plate. An outer side of the front support is completely encapsulated with the fluoropolymer and is integrated with the casing liner of the pump casing into one piece.

The volute has a front side vortex structure, which makes a flow center line of the impeller output positioned at the inner side of the center of the outlet of the pump. Therefore, the flow distance from the pump inlet to the inlet of the impeller is long enough so that the flow interference at the inlet of the impeller generated by the front support is greatly reduced.

The design of the structure of an impeller channel is that the shroud surface is orthogonal with the stationary shaft with a small tilting angle toward the hub plate, and the hub plate is orthogonal with the stationary shaft with a tilting angle toward the shroud surface, the geometry of the hub plate near the stationary shaft is a concave design matching with the curve surface of the front shaft seat, which makes the inlet channel of the blade leading edge of the impeller have sufficient flow space.

The stationary shaft is made of ceramic column whose diameter is all equaled. A front end of the stationary shaft is supported by the front shaft seat of the front support, and a rear end of the stationary shaft is supported by a rear shaft seat of the containment shell. When the pump operates in high power and high temperature, a composited stationary shaft is preferable. The composited stationary shaft with high stiffness is made of a metal shaft and a ceramic shaft sleeve together. The metal shaft is directly fixed to the metal front shaft seat of the front support and is pressed against the ceramic shaft sleeve tightly in high tension to form the composited stationary shaft with high stiffness. A rear end of the composited stationary shaft is supported by a rear shaft seat of the containment shell.

The containment shell is a cup-shaped and two-layer shell structure including a fluoropolymer casing liner (i.e. the inner layer) and a fiber reinforce layer (i.e. the outer layer), and forms a cylindrical and cup-shaped cantilever structure together. A shell flange reinforced by a backup plate at the front end of the containment shell, fixed between the pump casing and a bracket. A rear shaft seat without any through hole is positioned at the bottom side of the containment shell for ensuring zero leakage. The shell flange is connected to a flange of the pump casing and the pump side flange of the bracket for preventing a corrosive fluid leakage. A metal collar is installed between the two layers of the rear shaft seat for preventing the fluoropolymer from deformation at high temperature, and therefore, the metal collar offers a stable support for the stationary shaft and the rear thrust ring. The cantilever structure of the containment shell may provide the supporting stiffness for the stationary shaft.

The effects which are achieved by this invention are described as follows:

1. The melting temperature of the fluoropolymer is above 300° C. and the strength of the fluoropolymer is greatly reduced over the temperature of 200° C. The structure stiffness of the pump casing made of cast iron or stainless steel is independent with the fluoropolymer components so that the pump may operate with high reliability up to 200° C.

2. The structure of the front support is integrated with the pump casing into one piece and the front support is covered with the fluoropolymer for isolating the corrosive fluid so that most of the supporting stiffness of the stationary shaft comes from the front support, and the auxiliary support stiffness is provided by the rear shaft seat of the containment shell.

3. The metal structure of the pump casing is integrated with the front support into one piece and extends its axial length so that the front shaft seat of the front support extends towards the hub aperture for reducing the flow resistance of the inlet due to the front support.

4. In order to improve the channel structure and the inlet channel of the impeller, the cross-sectional area of the inlet channel is increased for reducing the flow velocity at the inlet of impeller and lowering the NPSHr. The cross-sectional area of the front support matches with the streamline of the flow so that the flow interference generated by the front support is reduced.

5. The containment shell is only used for sealing to prevent leakage, for high temperature and pressure resistance. The structure of the containment shell includes the inner layer structure made of the fluoropolymer and the outer layer reinforced structure. The inner layer is a cup-shaped fluoropolymer structure, and a rear shaft seat without any through hole is positioned at the center of a disc-shaped bottom side of the inner layer and protrudes and extends outwardly. The outer layer is a thermosetting-and-resin-fiber-reinforce structure for reducing the deformation of the fluoropolymer at high temperature, for bearing the pressure of the fluid to reduce the deformation and for bearing the impact from the flow.

The structure of the invention enables the magnetic drive pump within any power range to operate reliably up to 200° C. and is suitable for a simple stationary shaft structure and a composited shaft structure.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

Figure 1A:
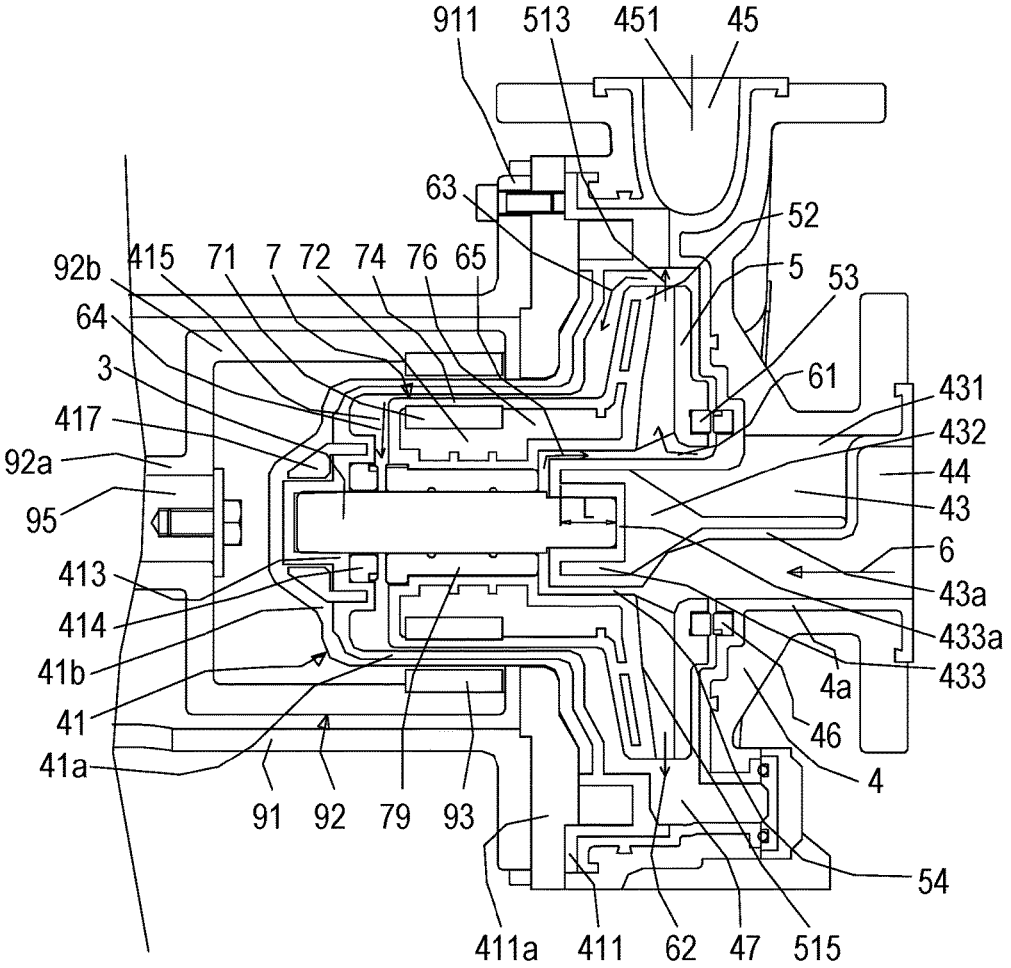
FIG. 1A is a cross-sectional view of a stationary shaft with double-sided-supporting according to a first embodiment.
Figure 3:
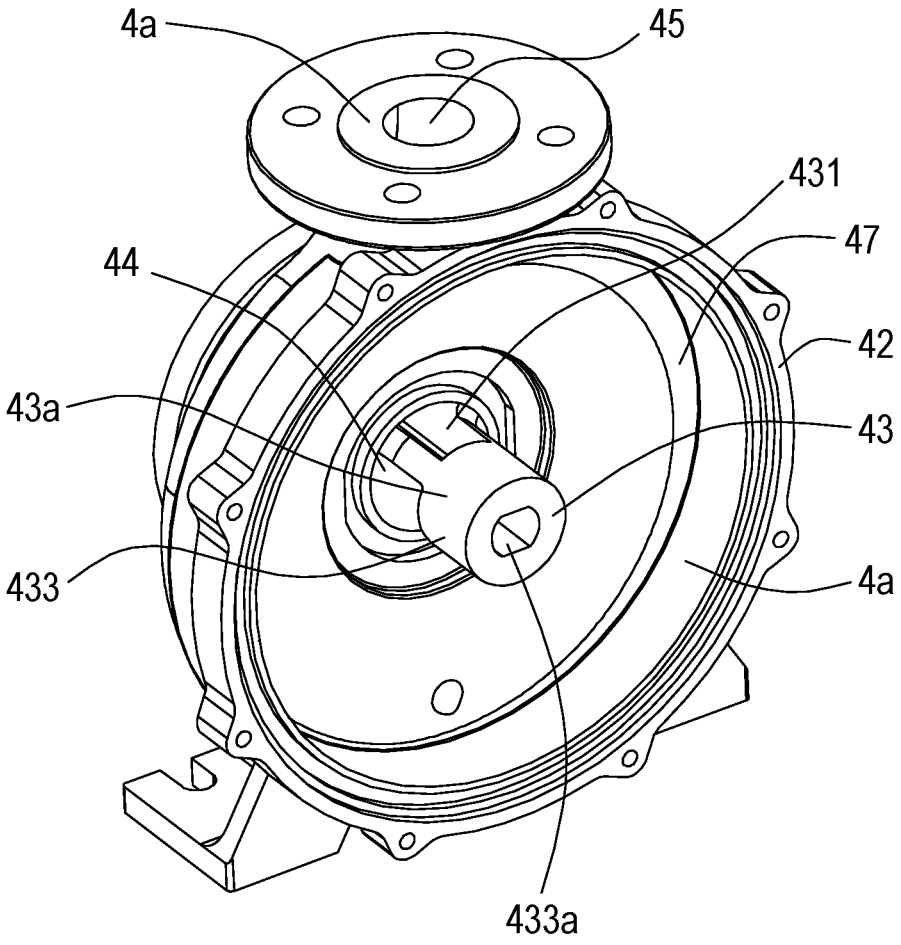
FIG. 3 is a perspective back view of a pump casing according to a first embodiment.
Figure 4A:
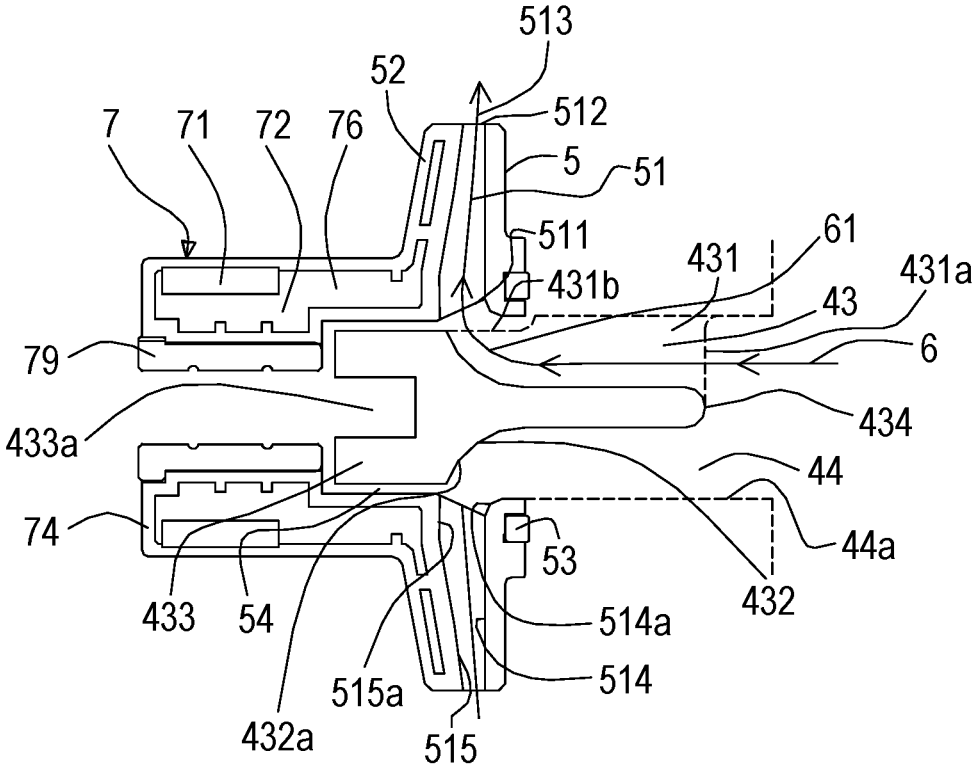
FIG. 4A is a cross-sectional view of a pump inlet according to a first embodiment.
Figure 5:
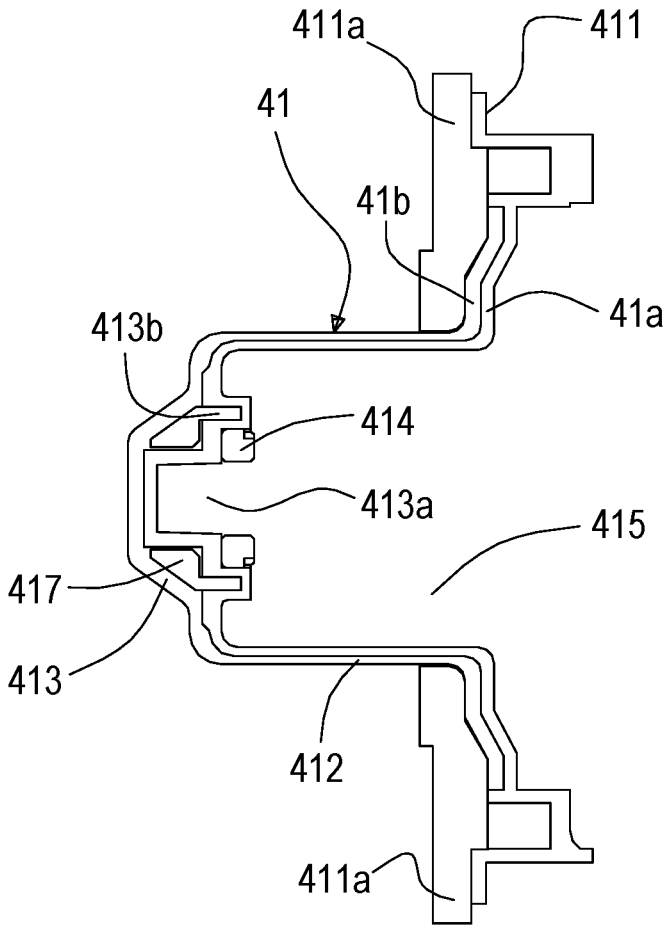
FIG. 5 is a cross-sectional view of a containment shell according to a first embodiment.
Figure 6:
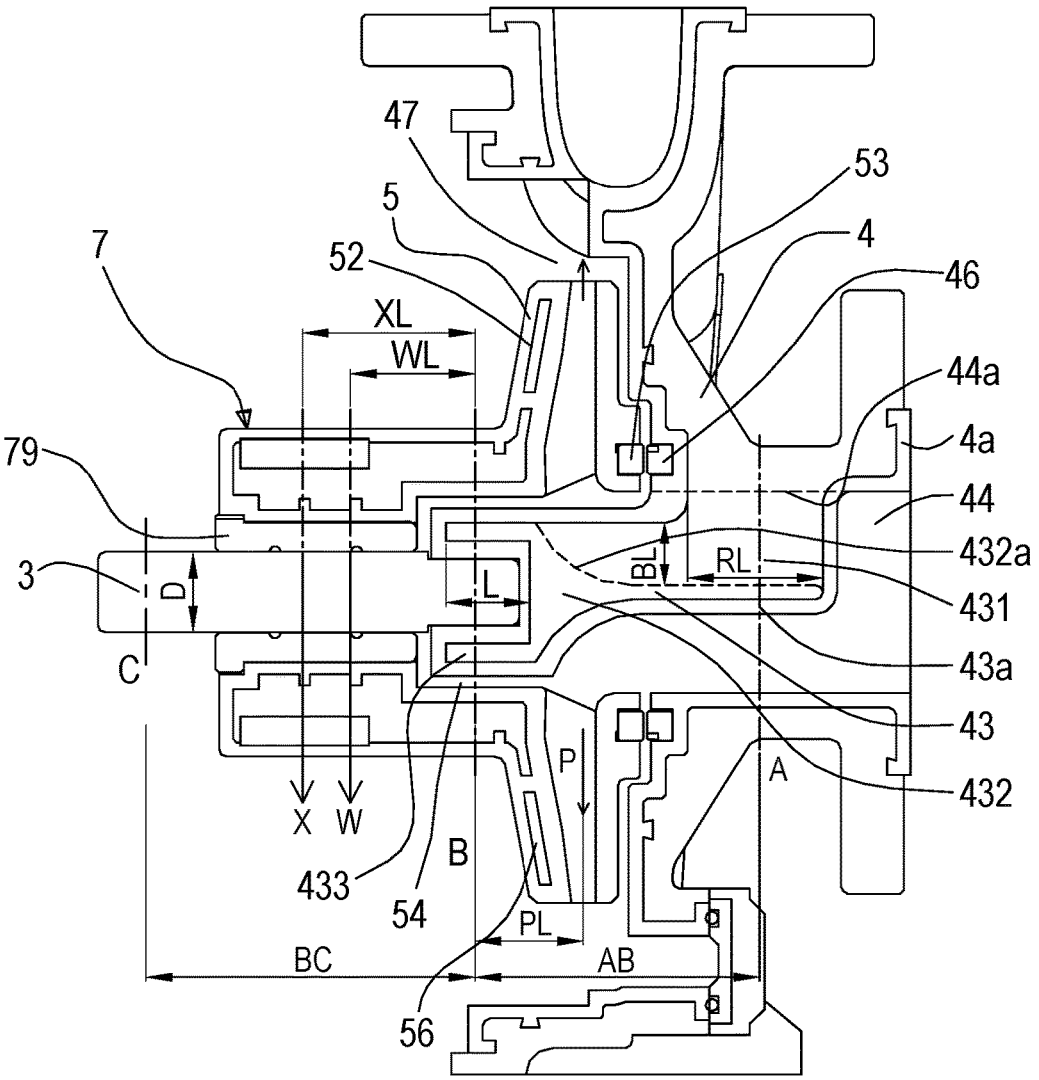
FIG. 6 is a cross-sectional view of a containment shell bearing a force and a moment according to a first embodiment.

First Embodiment: A Magnetic Drive Pump Including a Double-Sided-Supported Stationary Shaft Structure, FIG. 1A Please refer to FIGS. 1A, 3, 4A, 5 and 6, wherein FIG. 1A is a cross-sectional view of a stationary shaft with double-sided-supporting according to a first embodiment, FIG. 3 is a perspective back view of a pump casing according to a first embodiment, FIG. 4A is a cross-sectional view of a pump inlet according to a first embodiment, FIG. 5 is a cross-sectional view of a containment shell according to a first embodiment, and FIG. 6 is a cross-sectional view of a containment shell bearing a force and a moment according to a first embodiment. The magnetic drive pump in this invention includes the double-sided-supported stationary shaft structure. The magnetic drive pump comprises a pump casing 4, a front support 43, an impeller 5, a containment shell 41, an inner rotor 7, an out rotor 92, a stationary shaft 3 and a bracket 91.

The pump casing 4, made of cast iron or stainless steel, comprises a pump inlet 44, an outlet 45 and a volute 47. The pump casing 4 is used for containing the impeller 5 inside. A front thrust ring 46 is installed in a pump inlet 44 which is on the inside of the pump casing 4 for mating with a thrust bearing 53 at the inlet of the impeller 5 to form an axial thrust bearing together. A casing liner 4*a* is positioned on a fluid-contacting side which is inside of the pump casing 4 and the casing liner 4*a* is used for isolating corrosive fluid. An integrated front support 43 is positioned in the pump inlet 44. A casing back flange 42 (as shown in FIG. 3) which is installed on a rear end of the pump casing 4 is used for assembling a shell flange part 411 and a backup plate 411*a* of the containment shell 41 and combines with a bracket front flange 911 of the bracket 91 so that the leakage of the corrosive fluid should be avoided.

The front support 43 includes two rib plates 431 made of cast iron or stainless steel and extending axially toward the inside of the pump casing 4. The rib plates 431 extend inward from an inner surface of an inlet 44 of the pump casing 4 and combine together at the center of the inner diameter, combining into a structural component where the two ribs plate 431 are perpendicular to each other. A cone body 432 is formed at the combination of the two ribs plates 431 and the center of the cone body 432 corresponds to the center of the inner diameter. The cone body 432 extends inwardly towards the rear side of the pump casing 4. A front shaft seat 433 is positioned at the rear end of the front support 43 for supporting one end of the stationary shaft 3. The rib plates 431 extend axially according to the axial length of the cone body 432 and the width of the rib plates 431 is gradually reduced to match with the outer diameter of the front shaft seat 433, the front shaft seat 433 passes through a hub aperture 54 and an arc of the front shaft seat 433 forms a smooth curve surface with a hub plate 52. An outer surface of the front support 43 is completely encapsulated with the fluoropolymer and is integrated with the casing liner 4*a* into one piece.

The impeller 5 which is made of fluoropolymer is assembled in the pump casing 4. A hub aperture 54 is positioned at the center of a hub plate 52. The front support 43 axially passes through the hub aperture 54 and is used for supporting one end of the stationary shaft 3. A rear end of the hub plate 52 is used for combining with an axially extended part 76 of the inner rotor 7 so that the impeller 5 and the inner rotor 7 are integrated into one piece or are combined into one piece together. In some embodiments, a plate-shaped impeller reinforce plate 56 (as shown in FIG. 6) is installed in the hub plate 52 and used for transmitting shaft power to the transferred fluid. Moreover, the impeller reinforce plate 56 and an inner rotor yoke 72 of the inner rotor 7 may be integrated into one piece or are combined into one piece together.

The containment shell 41 is a two-layer shell structure including a containment shell liner 41*a* made of fluoropolymer and a reinforce layer 41*b*. A rear shaft seat 413 without any through hole is positioned on the bottom side of the containment shell 41 to make sure there is no leakage from the containment shell 41. The backup plate 411*a* of the shell flange part 411, installed on the front end of the containment shell 41, is used for being connected to the casing back flange 42 of the pump casing 4 (refer to FIG. 3 together) and the bracket front flange 911 of the bracket 91 together, and forming a cylindrical cup-shaped cantilever structure together for preventing the corrosive fluid from leakage. The backup plate 411*a* is used for ensuring the strength and fixing the front end of the shell flange part 411; A shell column part 412 (as shown in FIG. 5) on the lateral side of the containment shell 41 passes through inner space 415 of the out rotor 92, and furthermore an inner space 415 of the containment shell 41 is used for containing the inner rotor 7; The containment shell 41 is used for separating the inner rotor 7 and the out rotor 92, a gap exists between the containment shell 41 and the inner rotor 7, and another gap exists between the containment shell 41 and the out rotor 92, so that the frictions of the containment shell 41 with the inner rotor 7 or the out rotor 92, which may result in the leakage of the corrosive fluid, are avoided; The rear shaft seat 413 which is positioned at the center of the bottom side of the containment shell 41 extends axially and outwardly in the inside of the out rotor 92 and is used for supporting the other end of the stationary shaft 3. A rear thrust ring 414, installed on a outer side of the shaft hold hole 413*a*, is used for mating with a ceramic bearing 79 of the inner rotor 7 to form an axial thrust bearing. A metal collar 417 is installed between the two-layer structure outside the shaft hold hole 413*a* of the rear shaft seat 413 and is used for reducing the deformation of the containment shell liner 41*a* made of the fluoropolymer at high temperature, thereby offering a stable supporting for the stationary shaft 3 and the rear thrust ring 414. The containment shell 41 offers an auxiliary stiffness support for the stationary shaft 3.

The inner rotor 7 is a ring-shaped structure comprising multiple inner permanent magnets 71, an inner rotor yoke 72 and an axially extended part 76. The multiple inner permanent magnets 71 are installed on an outer ring surface of the inner rotor yoke 72. A rotor resin enclosure 74 made of anti-corrosion engineering plastic encapsulates the inner rotor 7 for preventing leakage. The ceramic bearing 79 is installed in the central hole of the inner rotor 7. An axially extended part 76 of the inner rotor 7 is used for combining with the hub plate 52 so that the inner rotor 7 and the impeller 5 are integrated into one piece or are combined into one piece together.

The out rotor 92 is a ring cup-shaped structure comprising multiple outer permanent magnets 93, an outer rotor yoke 92*b* and a shaft adapter 92*a*. The shaft adapter 92*a* and a drive motor shaft 95 are fixed to each other. The multiple outer permanent magnets 93 are installed on an interior ring surface of the outer rotor yoke 92*b*. The drive motor shaft 95 drives the out rotor 92 to rotate. The containment shell 41 is installed between the inner rotor 7 with inner permanent magnets 71 and outer rotor 92 with the outer permanent magnets 93, the out rotor 92 is installed at the outside and correspondingly positioned to the inner rotor 7, and both outer and inner magnets are arranged radially and oppositely, and are magnetically attracted to each other. When the out rotor 92 rotates, the outer permanent magnets 93 attract the inner permanent magnets 71 to drive the inner rotor 7 to rotate.

The stationary shaft 3 is a double-sided-supported structure made of ceramic material with anti-corrosion and wear resistance properties. The front end of the stationary shaft 3 is supported by the front support 43 of the pump casing 4 and the rear end of the stationary shaft 3 is supported and fixed by the rear shaft seat 413 of the containment shell 41. A central portion of the stationary shaft 3 mates with a ceramic bearing 79 of the inner rotor 7 to rotate. The length of the centeral portion satisfies with the length of the ceramic bearing 79 for bearing a combined force applied to the inner rotor 7 and an axial free-movement space of the inner rotor 7 is reserved. The rib plate 431 and the front shaft seat 433 of the front support 43 provide a highly stiff supporting for the stationary shaft 3 as well as a hold length L so that the problem that the strength of the plastic is reduced when the temperature rises is solved.

The bracket 91 is a column structure with double-sided flanges. One flange is used for fixing with another flange of the motor (not shown), and the bracket front flange 911 is used for being connected to the backup plate 411*a* of the shell flange part 411 of the containment shell 41 and the casing back flange 42 installed on the rear end of the pump casing 4, so that the leakage of the corrosive fluid is avoided. The backup plate 411*a* of the shell flange part 411 is used for ensuring the stiffness strength and the fixing.

When the pump operates, the fluid enters the pump inlet 44, i.e. along a streamline 6, and flows to the inlet of the impeller 5, i.e. along an inlet streamline 61. The fluid is pressurized after passing through a channel of the impeller 5 (i.e. along an impeller exit streamline 62), then is discharged through the outlet 45. At the same time, a portion of the fluid, i.e. along a turn back streamline 63, enters the inner space 415 of the containment shell 41 via the rear end of the impeller 5, then flows to the bottom side of the containment shell 41 via the gap between the outside of the inner rotor 7 and the inner-diameter space of the containment shell 41, i.e. along a lubrication streamline 64. Afterwards, the fluid flows through the gap between the stationary shaft 3 and the ceramic bearing 79, continuously through the hub aperture 54, i.e. along an end lubrication streamline 65, and return to the inlet of the impeller 5 anew. Such circular flowing of the fluid is used for offering the lubrication for the ceramic bearing 79 and dissipating the heat generated due to the lubrication.

Figure 1B:
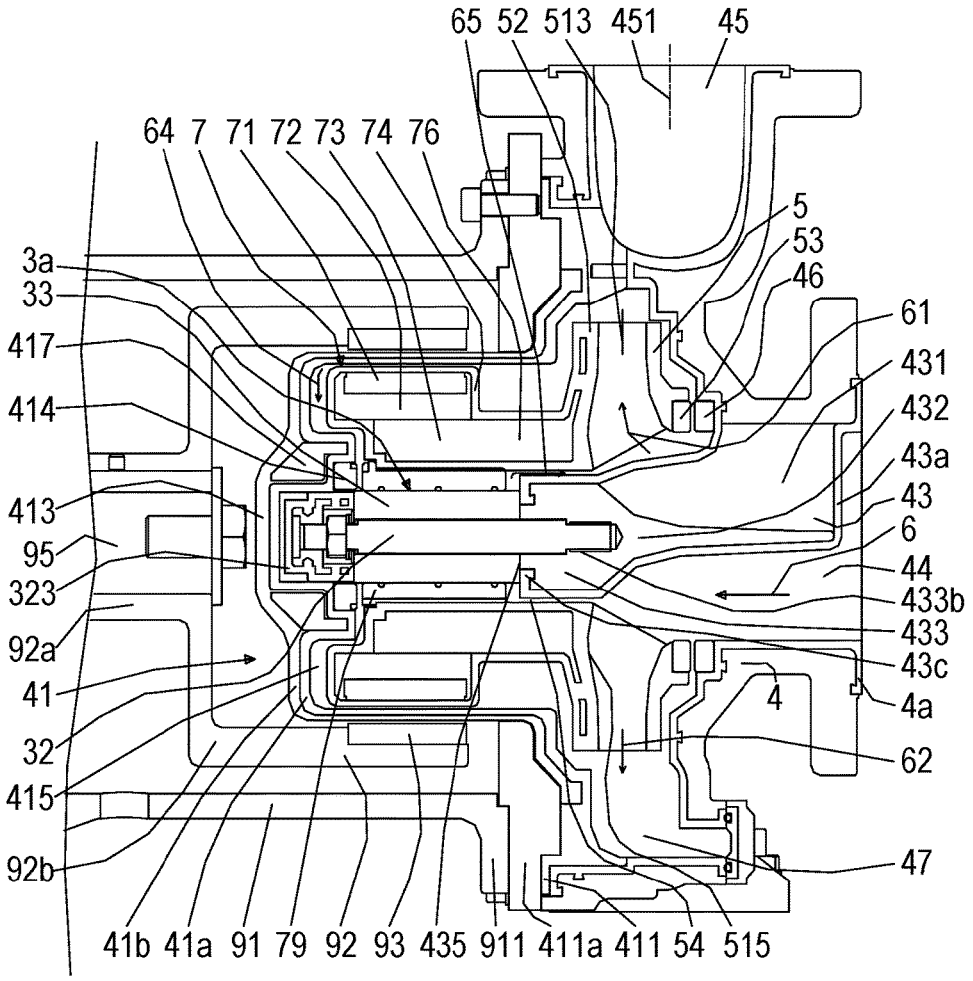
FIG. 1B is a cross-sectional view of a composited stationary shaft with double-sided-supporting according to a second embodiment.
Figure 4B:
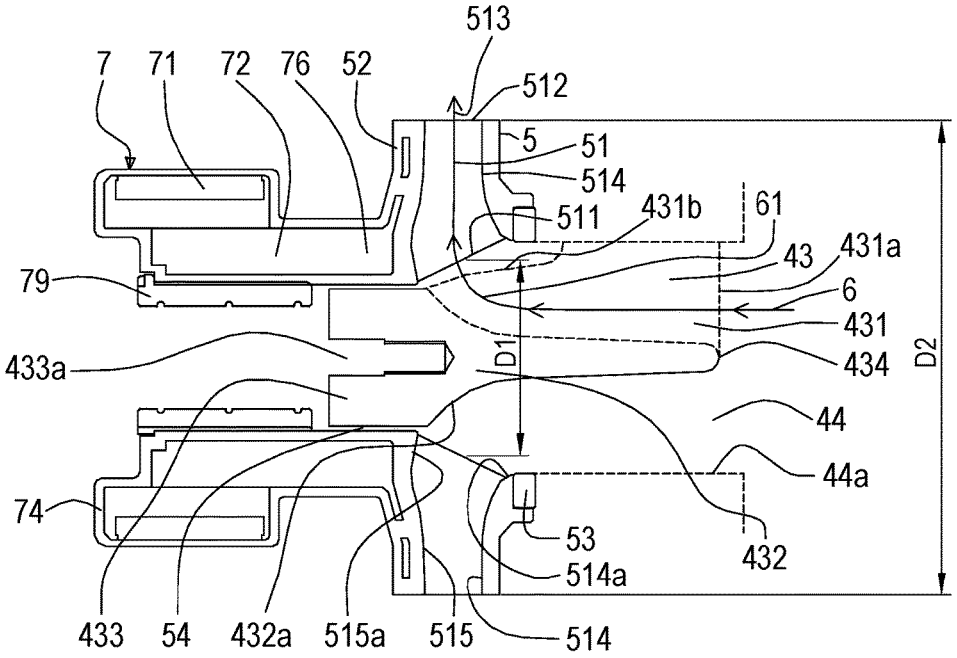
FIG. 4B is a cross-sectional view of a pump inlet according to a second embodiment.
Figure 7:
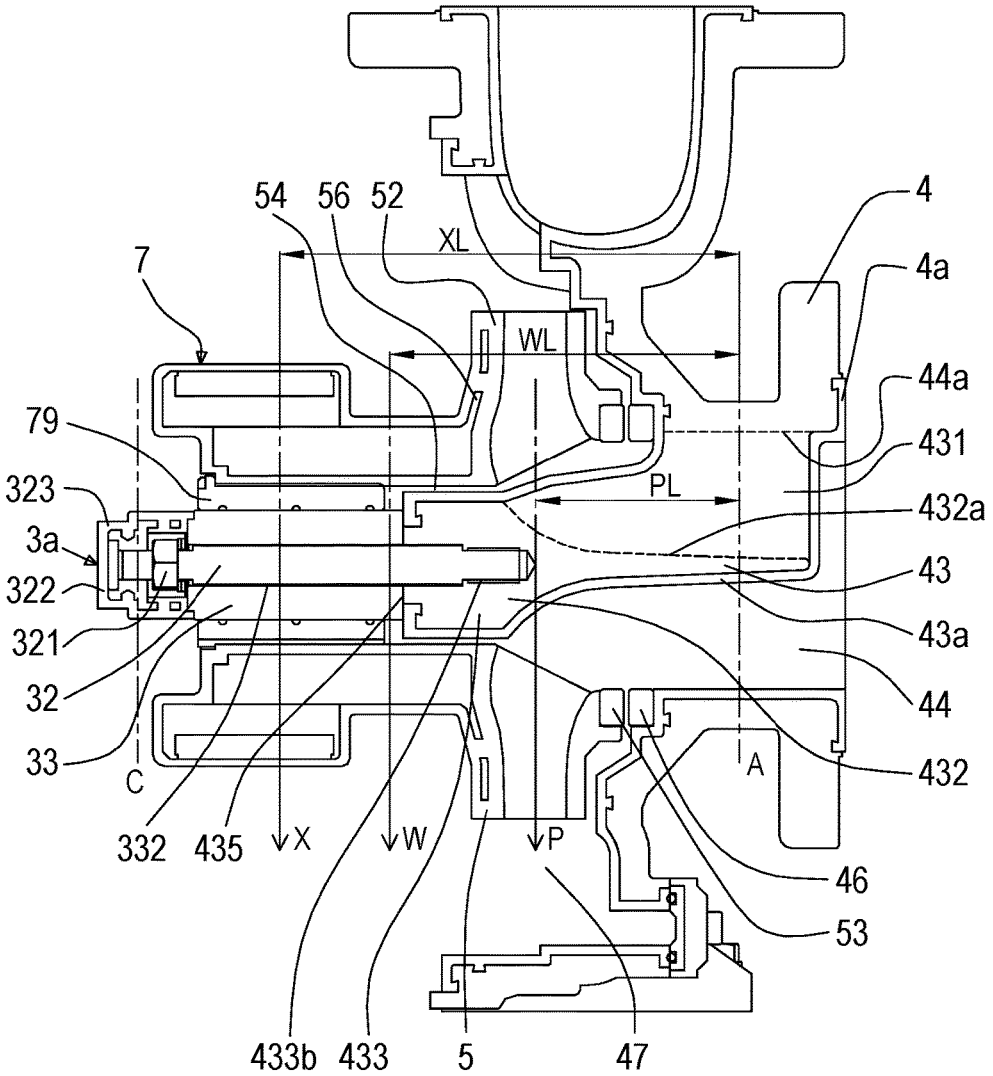
FIG. 7 is a cross-sectional view of a composited containment shell bearing a force and a moment according to a second embodiment.

Second Embodiment: A Magnetic Drive Pump which Includes a Double-Sided-Supported Composited Stationary Shaft is Applied in High Power and at High Temperature, FIG. 1B Please refer to FIGS. 1B, 4B and 7, wherein FIG. 1B is a cross-sectional view of a composited stationary shaft with double-sided-supporting according to a second embodiment, FIG. 4B is a cross-sectional view of a pump inlet according to a second embodiment, and FIG. 7 is a cross-sectional view of a composited containment shell bearing a force and a moment according to a second embodiment. The magnetic drive pump in this invention includes the double-sided-supported composited stationary shaft. The magnetic drive pump comprises a pump casing 4, a front support 43, an impeller 5, a containment shell 41, an inner rotor 7, an out rotor 92, a composited stationary shaft 3*a* and a bracket 91.

The pump casing 4, made of cast iron or stainless steel, comprises a pump inlet 44, an outlet 45 and a volute 47. The pump casing 4 is used for containing the impeller 5 inside. A front thrust ring 46 is installed in a pump inlet 44 which is on the inside of the pump casing 4 for mating with a thrust bearing 53 at the inlet of the impeller 5 to form an axial thrust bearing together. A casing liner 4*a* is positioned on a fluid-contacting side which is inside of the pump casing 4 and the casing liner 4*a* is used for isolating corrosive fluid. An integrated front support 43 is positioned in the pump inlet 44. A casing back flange 42 (as shown in FIG. 3) which is installed on a rear end of the pump casing 4 is used for assembling a shell flange part 411 and a backup plate 411*a* of the containment shell 41 and combines with a bracket front flange 911 of the bracket 91 so that the leakage of the corrosive fluid should be avoided.

The front support 43 includes two rib plates 431 made of cast iron or stainless steel and extending axially toward the inside of the pump casing 4. The rib plates 431 extend inward from an inner surface of an inlet 44 of the pump casing 4 and combine together at the center of the inner diameter, combining into a structural component where the two ribs plate 431 are perpendicular to each other. A cone body 432 is formed at the combination of the two ribs plates 431 and the center of the cone body 432 corresponds to the center of the inner diameter. The cone body 432 extends inwardly towards the rear side of the pump casing 4. A front shaft seat 433 is positioned at the rear end of the front support 43 for supporting one end of the stationary shaft 3. The rib plates 431 extend axially according to the axial length of the cone body 432 and the width of the rib plates 431 is gradually reduced to match with the outer diameter of the front shaft seat 433, the front shaft seat 433 passes through a hub aperture 54 and an arc of the front shaft seat 433 forms a smooth curve surface with a hub plate 52. An outer surface of the front support 43 is completely encapsulated with the fluoropolymer and is integrated with the casing liner 4*a* into one piece.

The shaft hold 433*a* (as shown in FIG. 4B) is not encapsulated inside. The shaft hold hole 433*a* include a thread hole 433*b* at the center of the shaft hold hole 433*a* and the thread hole 433*b* is used for tightly fixing a screw part which is at an end of a metal shaft 32 of the composited stationary shaft 3*a*. The inner diameter of the shaft hold hole 433*a* is matched with the outer diameter of the metal shaft 32 in a loose fit. The surface of the front shaft seat 433 is divided into two ring-shaped surfaces which are a tied surface 435 and a sealing surface 43*c*. The tied surface 435 is tightly pressed against and attached to a surface of the ceramic shaft sleeve 33 for ensuring the supporting stiffness of the composited stationary shaft 3*a*, and keep right compression ratio of the resin enclosure 43*a* at the sealing surface 43*c* so that the leakage from the corrosive fluid can be avoided.

The impeller 5 which is made of fluoropolymer is assembled in the pump casing 4. A hub aperture 54 is positioned at the center of a hub plate 52. The front support 43 axially passes through the hub aperture 54 and is used for supporting one end of the composited stationary shaft 3*a*. A rear end of the hub plate 52 is used for combining with an axially extended part 76 of the inner rotor 7 so that the impeller 5 and the inner rotor 7 are integrated into one piece or are combined into one piece together. In some embodiments, a plate-shaped impeller reinforce plate 56 (as shown in FIG. 6) is installed in the hub plate 52 and used for transmitting shaft power to the transferred fluid. Moreover, the impeller reinforce plate 56 and an inner rotor yoke 72 of the inner rotor 7 may be integrated into one piece or are combined into one piece together.

The containment shell 41 is a two-layer shell structure including a containment shell liner 41*a* made of fluoropolymer and a reinforce layer 41*b*. A rear shaft seat 413 without any through hole is positioned on the bottom side of the containment shell 41 to make sure there is no leakage from the containment shell 41. The backup plate 411*a* of the shell flange part 411, installed on the front end of the containment shell 41, is used for being connected to the casing back flange 42 of the pump casing 4 (refer to FIG. 3 together) and the bracket front flange 911 of the bracket 91 together, and forming a cylindrical cup-shaped cantilever structure together for preventing the corrosive fluid from leakage. The backup plate 411*a* is used for ensuring the strength and fixing the front end of the shell flange part 411; A shell column part 412 (as shown in FIG. 5) on the lateral side of the containment shell 41 passes through inner space 415 of the out rotor 92, and furthermore an inner space 415 of the containment shell 41 is used for containing the inner rotor 7; The containment shell 41 is used for separating the inner rotor 7 and the out rotor 92, a gap exists between the containment shell 41 and the inner rotor 7, and another gap exists between the containment shell 41 and the out rotor 92, so that the frictions of the containment shell 41 with the inner rotor 7 or the out rotor 92, which may result in the leakage of the corrosive fluid, are avoided; The rear shaft seat 413 which is positioned at the center of the bottom side of the containment shell 41 extends axially and outwardly in the inside of the out rotor 92 and is used for supporting the other end of the composited stationary shaft 3*a*. A rear thrust ring 414, installed on a outer side of the shaft hold hole 413*a*, is used for mating with a ceramic bearing 79 of the inner rotor 7 to form an axial thrust bearing. A metal collar 417 is installed between the two-layer structure outside the shaft hold hole 413*a* of the rear shaft seat 413 and is used for reducing the deformation of the containment shell liner 41*a* made of the fluoropolymer at high temperature, thereby offering a stable supporting for the composited stationary shaft 3*a* and the rear thrust ring 414. The containment shell 41 offers an auxiliary stiffness support for the composited stationary shaft 3*a*.

The inner rotor 7 is a ring-shaped structure comprising multiple inner permanent magnets 71, an inner rotor yoke 72 and an axially extended part 76. The multiple inner permanent magnets 71 are installed on an outer ring surface of the inner rotor yoke 72. A rotor resin enclosure 74 made of anti-corrosion engineering plastic encapsulates the inner rotor 7 for preventing leakage. The ceramic bearing 79 is installed in the central hole of the inner rotor 7. An axially extended part 76 of the inner rotor 7 is used for combining with the hub plate 52 so that the inner rotor 7 and the impeller 5 are integrated into one piece or are combined into one piece together The out rotor 92 is a ring cup-shaped structure comprising multiple outer permanent magnets 93, an outer rotor yoke 92*b* and a shaft adapter 92*a*. The shaft adapter 92*a* and a drive motor shaft 95 are fixed to each other. The multiple outer permanent magnets 93 are installed on an interior ring surface of the outer rotor yoke 92*b*. The drive motor shaft 95 drives the out rotor 92 to rotate. The containment shell 41 is installed between the inner rotor 7 with inner permanent magnets 71 and outer rotor 92 with the outer permanent magnets 93, the out rotor 92 is installed at the outside and correspondingly positioned to the inner rotor 7, and both outer and inner magnets are arranged radially and oppositely, and are magnetically attracted to each other. When the out rotor 92 rotates, the outer permanent magnets 93 attract the inner permanent magnets 71 to drive the inner rotor 7 to rotate.

The composited stationary shaft 3*a* is a double-sided-supporting structure. A front end of the composited stationary shaft 3*a* is supported by the front support 43 of the pump casing 4 and a rear end of the composited stationary shaft 3*a* is supported by the rear shaft seat 413 of the containment shell 41. A central portion of the composited stationary shaft 3*a* mates with a ceramic bearing 79 of the inner rotor 7 to rotate. The length of the central portion satisfies with the length of the ceramic bearing 79 for bearing a combined force applied to the inner rotor 7 and axial free-movement space of the inner rotor 7 is reserved. The rib plate 431 and the front shaft seat 433 of the metal front support 43 offer highly stiff support for the composited stationary shaft 3*a* so that the problem that the strength of the plastic is reduced when the temperature rises is solved.

The composited stationary shaft 3*a* comprises a ceramic shaft sleeve 33, a metal shaft 32 and a sealing nut 323. The metal shaft 32, of which both ends with screw parts, passes through a sleeve central hole 332 of the ceramic shaft sleeve 33. An end of a screw part of the metal shaft 32 is fixed with a thread hole 433*b* positioned at the center of the front shaft seat 433 of the front support 43, the other end of the screw part utilizes a tied nut 321 (refer to FIG. 7) to press against a rear surface of the ceramic shaft sleeve 33.

A front surface of the ceramic shaft sleeve 33 is tightly pressed against the tied surface 435 and the sealing surface 43*c* positioned on the front shaft seat 433 of the front support 43. The rear surface of the ceramic shaft sleeve 33 is tightly pressed by the tied nut 321 for ensuring the supporting stiffness of the composited stationary shaft 3*a* and keeps right compression ratio of the resin enclosure 43*a* at the sealing surface 43*c* so that the leakage from the corrosive fluid can be avoided. The sealing nut 323 is a cup-shaped cylindrical metal component which is covered with the resin enclosure 322 (refer to FIG. 7 together). The thread hole of the sealing nut 323 is not encapsulated. The sealing nut 323 is tightly fixed on the rear end of the metal shaft 32 for sealing the composited stationary shaft 3*a* up completely. The opening surface of the sealing nut 323 is tightly pressed against the rear surface of the ceramic shaft sleeve 33 and used for sealing and anticorrosion so that the composited stationary shaft 3*a* is formed. The cylindrical outer-diameter surface of the sealing nut 323 may be supported by the rear shaft seat 413 of the containment shell 41.

The bracket 91 is a column structure with double-sided flanges. One flange is used for fixing with another flange of the motor (not shown), and the bracket front flange 911 is used for being connected to the backup plate 411*a* of the shell flange part 411 of the containment shell 41 and the casing back flange 42 installed on the rear end of the pump casing 4, so that the leakage of the corrosive fluid is avoided. The backup plate 411*a* of the shell flange part 411 is used for ensuring the stiffness strength and the fixing.

When the pump operates, the fluid enters the pump inlet 44, i.e. along a streamline 6, and flows to the inlet of the impeller 5, i.e. along an inlet streamline 61. The fluid is pressurized after passing through a channel of the impeller 5 (i.e. along an impeller exit streamline 62), then is discharged through the outlet 45. At the same time, a portion of the fluid, i.e. along a turn back streamline 63, enters the inner space 415 of the containment shell 41 via the rear end of the impeller 5, then flows to the bottom side of the containment shell 41 via the gap between the outside of the inner rotor 7 and the inner-diameter space of the containment shell 41, i.e. along a lubrication streamline 64. Afterwards, the fluid flows through the gap between the stationary shaft 3 and the ceramic bearing 79, continuously through the hub aperture 54, i.e. along an end lubrication streamline 65, and return to the inlet of the impeller 5 anew. Such circular flowing of the fluid is used for offering the lubrication for the ceramic bearing 79 and dissipating the heat generated due to the lubrication.

Figure 2A:
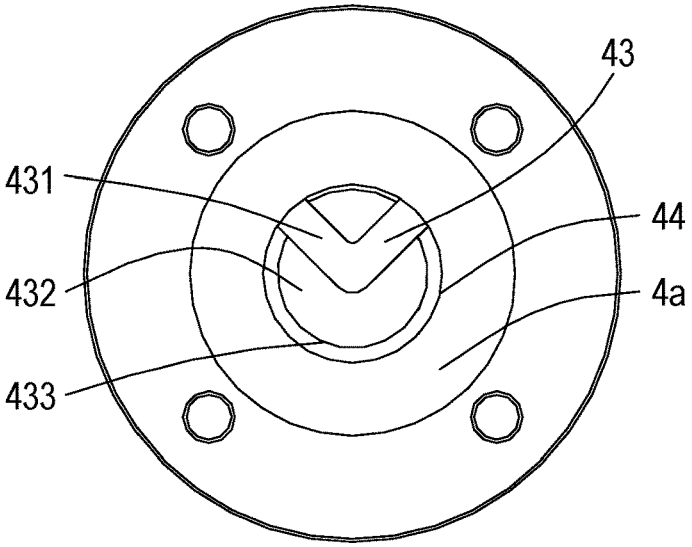
FIG. 2A is a front view of a pump inlet according to a first embodiment.
Figure 2B:
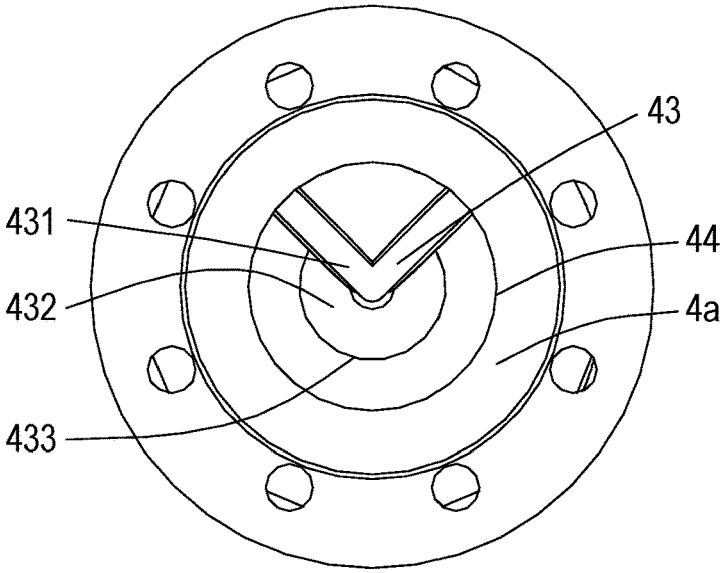
FIG. 2B is a front view of a pump inlet according to a first embodiment.

Please refer to FIGS. 2A and 2B, FIG. 2A is a front view of a pump inlet 44 according to the first embodiment; and FIG. 2B is a front view of a pump inlet 44 according to the second embodiment. The front support 43 comprises the two rib plates 431 extending axially and toward the inside of the pump casing 4 and combining into a structural component where the two rib plates 431 are perpendicular to each other, and a cone body 432 is formed at the combination of the two ribs plates 431 and the center of the cone body 432 corresponds to the center of the inner diameter of the pump inlet 44. The front shaft seat 433 positioned on the rear end of the front support 43. The rib plates 431 extend axially according to the axial length of the cone body 432 and the width of the rib plates 431 is gradually reduced to match with the outer diameter of the front shaft seat 433. An outer side of the front support 43 is completely encapsulated with the fluoropolymer and is integrated with the casing liner 4*a* of the pump casing 4 into one piece. The two rib plates 431 are combined together to form a cantilever structure passing axially through the hub aperture 54 and combining with the pump casing 4 into one piece.

The cross-sectional area of the rib plate 431 and the cone body 432 plus the thickness of the resin enclosure 43*a* is the blockage area of the cross-sectional area of the inlet channel. The residual cross-sectional area of the inlet channel is the flowing area. When the blocking area is increased, the effective flowing area is reduced accordingly. The flow velocity of the fluid is inversely and linearly proportional to the flow area, and the flow resistance is greatly proportional to the square of the flow velocity. In other words, the resistance is quadratic proportional to the reciprocal of increase of the effective flow area. The two following embodiments describe the inner diameter of the pump inlet 44 which is not increased particularly. FIG. 2A shows the specification with small caliber and low power in the first embodiment, and the blocking area is approximately less than 28% of the cross-sectional area of the pump inlet 44. For example, inlet diameter of the pump inlet 44 is 50 mm. FIG. 2B shows the specification with large caliber and high power in the second embodiment, and the blocking area is approximately less than 15% of the cross-sectional area of the pump inlet 44. For example, inlet diameter of the pump inlet 44 is 100 mm. The ratio of the blocking area to the flowing area also depends on manufacturing methods. For example, the thickness of the rib plate 431 made of cast iron or stainless steel by sand casting is similar to 6 mm, and each side of the resin enclosure is above or equal to 3 mm so the total thickness of the rib plate is similar to 12 mm. Compared to the pump with low power and the small caliber of the pump inlet 44 is of, for example, 50 mm, the blocking area is relatively higher. If we use the conventional triangle front support made of cast iron and the diameter of the pump inlet 44 is 50 mm, the ratio of the blocking area to the flowing area is above 40% after the resin enclosure is covered, it is unfavorable for reducing the flow resistance. That is the reason that in this invention, a right angle structure is introduced.

Please refer to FIG. 3, which specifically describes the pump casing 4 and the front support 43 in the first embodiment. The pump casing 4 comprises the pump inlet 44, the outlet 45 and the volute 47. The pump casing 4 is used for containing the impeller 5 (please refer to FIG. 1A together). The casing liner 4*a* is installed on a fluid-contacting side of the pump casing 4 and is used for isolating the corrosive fluid. The integrated front support 43 is installed in the pump inlet 44. The casing back flange 42, on the rear end of the pump casing 4, is used for combining the bracket 91 (please refer to FIG. 1A together) and the backup plate 411*a* of a containment shell 41 together (please refer to FIG. 1A together) to prevent the corrosive fluid from leakage. The front support 43 has the right angle structure feature with the front shaft seat 433, the shaft hold hole 433*a* is used for supporting an end of the stationary shaft 3 (please refer to FIG. 1A together). In the inner surface of the shaft hold hole 433*a* has a pair of cutting edges parallel and opposite to each other for installing the stationary shaft 3.

Please refer to FIG. 4A, which describes the front support 43, an impeller 5 and a pump casing 4 in the first embodiment. The impeller 5 is assembled in the pump casing 4 (please refer to FIG. 1A together). A front support 43 may axially pass through the hub aperture 54. The inner rotor 7 is encapsulated with a resin enclosure 74 made of fluoropolymer. The ceramic bearing 79 is installed in the central hole of the inner rotor 7. The hub plate 52 is used for being connected to the axially extended part 76 of the inner rotor 7 so that the impeller 5 and the inner rotor 7 are integrated into one piece or are combined into one piece together.

Please refer to FIG. 1A together, the impeller 5 is shifted a distance in the axial direction with respect to the pump casing 4, which makes the flow center line 513 of the impeller 5 positioned on the inner side of the center line 451 of the pump outlet 45 so that the distance of the inlet flow of the streamline 6 before entering the inlet of the impeller 5 is increased.

Please refer to FIG. 4A, the impeller 5 is a centrifugal type structure. A shroud surface 514 is orthogonal with the stationary shaft 3 with a small tilting angle toward the hub plate 52, and the hub plate 52 is orthogonal with the stationary shaft 3 with a tilting angle toward the shroud surface 514, the geometry of the hub plate 52 near the stationary shaft 3 is a concave design matching with the curve surface of the front shaft seat 433, which makes the inlet channel of the blade leading edge of the impeller 5 have sufficient flow space; and a shroud curve surface 514*a* in the vicinity of the blade leading edge 511 of the inlet of the impeller 5 has an adequate radius of curvature. A hub concave surface 515*a* is designed to be positioned in the vicinity of the blade leading edge 511 of a hub surface 515 corresponding to a cone curve surface 432*a* of a cone body 432 of the front support 43. Therefore, the inlet streamline 61 has preferable radius of curvature so that the flow interference of the inlet of the impeller 5 generated by the front support 43 is reduced.

A fluid which flows from of the pump inlet 44 through the flow center line 513 of the impeller 5 via a streamline 6 and an inlet streamline 61 may be maintained smoothly. An inner diameter cylindrical inner surface 44*a* of the pump inlet 44 of a pump casing 4, a shroud curve surface 514*a* and a shroud surface 514 form a smooth surface together. The diameter of the front end of the cone body 432 is equal to the thickness of the rib plate 431. After the cone body 432 axially extends to the inlet of impeller 5, the diameter of the cone body 432 is increased to be equal to the outer diameter of the front shaft seat 433 with a conic surface, and the cone curve surface 432*a* of the cone body 432 and the hub concave surface 515*a* of the hub surface 515 of the impeller 5 form a smooth curve surface together.

Therefore, after axially entering the pump inlet 44 along the streamline 6, the fluid turns into a radial flowing direction through the inlet streamline 61 and the flow center line 513. During such flowing, in the inner space of the pump inlet 44, only the thickness of the rib plates 431 is the blocking area of the channel, and a smooth variation of the cross-sectional area of the channel is obtained by adjusting the inner diameter of the inner cylindrical inner surface 44*a*. Moreover, a large expanding angle of the channel is not necessary, and the preferable radius of curvature of the inlet streamline 61 is obtained as well. The main factors in affecting the flowing are the thickness of the rib plates 431 and the variation of the diameter of the channel extending axially from the nose 434 to the cone body 432. In other words, after the fluid which enters the pump inlet 44 flows through the streamline 6 and the plate leading edge 431*a* (indicating by dashed line) of the rib plate 431 (indicating by dashed line), the flow velocity of the fluid is increased and the minimum interference is achieved. Since the flow distance of the streamline 6 is longer, after the fluid flows through the rib plates 431 (indicating by dashed line), the fluid is rectified to flow smoothly, and the flow resistance is reduced as well. when the fluid exits from the plate trailing edge 431*b* (indicating by dashed line) of the rib plate 431 (indicating by dashed line) and is ready to enter the blade leading edge 511 of the impeller 5, because there is a flow space between the blade leading edge 511 of the impeller 5 and the plate trailing edge 431*b* (indicating by dashed line) of the rib plate 431 (indicating by dashed line) as well as the inlet streamline 61 has the preferable radius of curvature, the flow interference is greatly reduced and the low flow resistance is maintained here.

The lower value of NPSHr represents better anti-cavitation ability. The key factor of lower NPSHr are that the flow velocity of the fluid is lower at the inlet of the impeller 5; when the fluid flows through the blade leading edge 511 of the blade 51, the pump having the sufficient cross-sectional area of the channel enables the fluid to flow at low flow velocity. The sufficient cross-sectional area of the channel in the vicinity of the blade leading edge 511 is the key point in the present invention.

Please refer to FIG. 4B, which shows the impeller 5 and the inner rotor 7 in the second embodiment. The FIG. 4A already describes the inlet channel and the impeller channel in detail and hereinafter describes the advantages of this design with FIG. 4B. Practically, the outer diameter of the impeller 5 needs to be trimmed according to actual requirement of the head output of the pump to match with the manufacturing process, the manufacture of the fluoropolymer impeller 5 is expensive, and the specifications of the impeller 5 may be too few to choose. Therefore, the front support 43 of the present invention has an advantage of that the impeller 5 can be trimmed 20% greater than the maximum outer diameter D2. FIG. 4B shows the pump with high power requirement. The ratio of the caliber D1 of the inlet of the impeller 5 to the outer diameter D2 of the outlet of the impeller 5 is much greater than the ratio of the impeller 5 in FIG. 4A, which shows the pump with low flow rate, high head and low power. When the outer diameter of the impeller 5 is trimmed, the outer diameter D2 of the blade trailing edge 512 of the blade 51 of the impeller 5 is reduced. That is to say, after the impeller 5 is trimmed, the ratio of D1/D2 is increased, and the greater the ratio of D1/D2 is, the lower the pump efficiency is, and the reason is that the working condition of the trimmed impeller 5 is far from the original optimal design. On the contrary, when the front support 43 is replaced by the conventional triangle front support and the inner diameter of the pump inlet 44 is increased and the caliber D1 of the inlet of the impeller 5 will also become larger, the flow velocity of the inlet of the impeller 5 may be decreased and the flow resistance is reduced, but after the impeller 5 is trimmed, the ratio D1/D2 will increase rapidly, and the possible operation range by trimming the impeller 5 will be reduced.

Please refer to FIG. 5, the containment shell 41 is a two-layer shell structure including a containment shell liner 41*a* made of fluoropolymer and a reinforce layer 41*b*. A rear shaft seat 413 without any through hole is positioned on the bottom side of the containment shell 41 to make sure there is no leakage from the containment shell 41. The backup plate 411*a* of the shell flange part 411, installed on the front end of the containment shell 41, is used for being connected to the casing back flange 42 of the pump casing 4 (refer to FIG. 3 together) and the bracket front flange 911 of the bracket 91 together, and forming a cylindrical cup-shaped cantilever structure together for preventing the corrosive fluid from leakage. The backup plate 411*a* is used for ensuring the strength and fixing the front end of the shell flange part 411.

The containment shell 41 is a cantilever structure, when the stationary shaft 3 bears a radial force, the containment shell 41 is completely supported by the shell flange part 411. The strength of the containment shell 41 completely depends on the support from the fiber reinforce layer 41*b*, which withstands the fluid pressure from the inner space 415, and the shell column part 412 has the maximum deformation under pressure. The metal collar 417, installed around the shaft hold hole 413*a* and between the fluoropolymer containment shell liner 41*a* and the reinforce layer 41*b* of the containment shell 41, is inserted into the ring slot 413*b*. Therefore, the deformation of the fluoropolymer containment shell liner 41*a* of the containment shell 41 at high temperature is reduced and the auxiliary support of the stationary shaft 3 (refer to FIG. 1A together) and the rear thrust ring 414 is offered.

Please refer to FIGS. 2A, 2B, 6. The front support 43 is made by the two rib plates 431 combined perpendicularly to each other according to the disclosure. The conventional symmetric triangle front support has a better structure strength but its cross-sectional area of the channel may not meet with requirement in this invention. The cross-sectional area of the channel of the perpendicular structure which is disclosed in this invention may meet with the requirement as shown in FIG. 4A, and the strength of the perpendicular structure may satisfy with the design principle and are described as follows:

When the front shaft seat 433 bears the radial force P and the moment from the stationary shaft 3, the force and the moment are transferred to the rib plates 431 via the cone body 432, then to the pump casing 4. The radial force P, applied on the front shaft seat 433, may be divided into two components perpendicular to each other with different values. The two rib plates 431 perpendicular to each other may bear the two components of the forces simultaneously as well as the moment effectively. The arrangement of the structure strength of the rib plates 431 is that the rib plates 431 have sufficient thickness and width BL, and the rib plates 431 and the front shaft seat 433 have a sufficient combined length equal to the length of the cone curve surface 432*a*. Moreover, the rib plates 431 which extend axially from the inside of the pump inlet 44 of the pump casing 4 have a sufficient rib plate axial width RL. That is to say, the cone curve surface 432*a* not only enables the fluid to flow smoothly but also bears and transfers the forces and the moments. Thus, the front support 43 in this invention may reduce the flow resistance and obtain the required supporting stiffness.

Please refer to FIG. 6. The rib plates 431 first extend axially from the inner surface of the pump inlet 44 toward the center of the inner diameter of a pump inlet 44 of the pump casing 4 and combine together at the center of the inner diameter. The cone body 432 at the combination position of the two rib plates 431, extends axially from the inside of the pump inlet 44, and the center of the cone body 432 corresponds to the center of the pump inlet 44. The front shaft seat 433 is used for supporting one end of the stationary shaft 3. Because of the well durable compression ability, the fluoropolymer may bear a great scale of compression without fatigue failure. When the stationary shaft 3 is installed on the front shaft seat 433, an adequate compression ratio and the appropriate hold length L bear a radial force P and a moment. Because the deformation of the resin enclosure 43*a* causes the primary deformation and movement of the stationary shaft 3, the sufficient compression and the hold length L enables the force to transfer to the front support 43 easily. The hold length L is at least 50% of the diameter of the stationary shaft 3.

Please refer to FIG. 6. The stationary shaft 3 and supporting structure thereof must bear multiple load forces including an inner rotor weight W, an eccentric centrifugal force X, a radial force P and moments thereof. The inner rotor weight W is the force generated by the weight of the rotor. The eccentric centrifugal force X is due to the gap of the ceramic bearing 79. The radial force P is a force applying to the impeller 5 due to uneven fluid pressure of a volute 47 in the pump casing 4. The directions of the eccentric centrifugal force X and the radial force P are varied according to the operation conditions in the radial direction.

Please refer to FIG. 6, when the multiple forces are applied to the stationary shaft 3, moments are generated by moment arms. Take the primary deformation of the front shaft seat 433 as an example. The reference position of the moment arm is subject to a reference line B positioned at the front shaft seat 433. The moment of the weight is equal to the inner rotor weight W times the weight arm length WL.

The moment of the eccentric centrifugal force is equal to the eccentric centrifugal force X times the eccentric length XL. The moment of the radial force is equal to the radial force P times the radial force arm length PL. The sum of above-mentioned forces and moments become a joint force and a joint moment applying to the front shaft seat 433. The eccentric centrifugal force X, which is generated from the wear of the ceramic bearing 79 to become bigger gap, is the main variation loading source of the stationary shaft 3. The more the wear is, the greater the eccentric centrifugal force X is. The longest moment arm is the eccentric length XL from the middle of the ceramic bearing 79 to the middle of the front shaft seat 433. The shortest moment arm is the radial force arm length PL. The radial force P causes a tilt between the axis of the inner rotor 7 and the axis of the stationary shaft 3, which leads to a continuous deformation of the supporting structure, and the deformation takes place on the front support 43.

Being subject to a reference line A as the center reference point positioning at middle of the rib plate 431, the joint force of the front shaft seat 433 is applied by the inner rotor weight W, the eccentric centrifugal force X and the radial force P together, and the moments thereof are borne by the front support 43. The value of the moment is equal to the joint force of the front shaft seat 433 times an arm length AB.

Please refer to FIG. 6. The strength of the containment shell 41 (refer to FIG. 1A together) made of the anti-corrosion material is reduced when the temperature rises, the deformation happens due to the rise of the pressure as well. Being subject to a reference line C as the center reference point of the rear shaft seat 413 of the containment shell 41, the rear shaft seat 413 is applied by a less portion of the joint force, and the joint force is mainly applied on the front shaft seat 433. The arm length BC, a distance from the reference line B to the reference line C, times the applying force is the value of the applying moment at the rear shaft seat 413. The arm length BC is longer than the arm length AB (i.e. the rear shaft seat 413 bears less moment and force), so most of the forces and moments are borne by the front support 43 via the stationary shaft 3.

Please refer to FIG. 7, which is a cross-sectional view of a composited containment shell 41 bearing a force and a moment according to the second embodiment. The front end of the composited stationary shaft 3*a* is supported by the front support 43 of the pump casing 4, and the rear end of the composited stationary shaft 3*a* is supported by the rear shaft seat 413 (refer to FIG. 1B together) of the containment shell 41. The composited stationary shaft 3*a* comprises the ceramic shaft sleeve 33, the metal shaft 32 and the sealing nut 323. The metal shaft 32 passes through the sleeve central hole 332 of the ceramic shaft sleeve 33. The end of the screw part of the metal shaft 32 is fixed with the thread hole 433*b* positioned at the center of the front shaft seat 433 of the front support 43. Another end of the screw part utilizes the tied nut 321 to press against the rear surface of the ceramic shaft sleeve 33. Therefore, the combined stationary shaft 3*a* with high stiffness is formed. The sealing nut 323 is tightly fixed on the rear end of the metal shaft 32 for sealing the composited stationary shaft 3*a* up completely. The cylindrical outer diameter of the sealing nut 323 is supported by the rear shaft seat 413 of the containment shell 41.

The middle portion of the composited stationary shaft 3*a* mates with the ceramic bearing 79 of the inner rotor 7 rotating accordingly. The length of the middle portion meets with the length of the ceramic bearing 79 to bear the combined force from the inner rotor 7.

The rib plates 431 and the front shaft seat 433 of the metal front support 43 offer the highly stiff support for the composited stationary shaft 3*a* to overcome the problem of reducing the strength of the plastic material when temperature rises.

Please refer to FIG. 7. When the radial forces P and the moments apply to the composited stationary shaft 3*a*, the front support 43 is applied by the radial forces P and the moments as well, generating the deformation and the movement of the front support 43.

Please refer to FIG. 7. The center portion of the composited stationary shaft 3 mates with the ceramic bearing 79 of the inner rotor 7 so that the composited stationary shaft 3*a* supports the rotation of the inner rotor 7 accordingly. The length of the center portion meets with the length of the ceramic bearing 79. The composited stationary shaft 3*a* and the supporting structure thereof need to bear the multiple forces including an inner rotor weight W, an eccentric centrifugal force X, a radial force P and moments thereof. The inner rotor weight W is the force generated by the weight of the rotor. The eccentric centrifugal force X is an eccentric centrifugal force of the centroid of the rotor due to the gap of the ceramic bearing 79. The radial force P is a force applying to the impeller 5 due to an uneven fluid pressure of the volute 47 of the pump casing 4.

Please refer to FIG. 7. The multiple forces are applied to the composited stationary shaft 3*a*, moments is generated by moment arms as well. The reference position of a moment arm is subject to a reference line A of the front support 43.

The moment of the weight is equal to the inner rotor weight W times the weight arm length WL. The moment of the eccentric centrifugal force is equal to the eccentric centrifugal force X times the eccentric length XL. The moment of the radial force is equal to the radial force P times the radial force arm length PL. The sum of above-mentioned forces and moments become a joint force and a joint moment applying to the front support 43. The eccentric centrifugal force X, which is generated from the wear of the ceramic bearing 79 to become bigger gap, is the main variation loading source of the composited stationary shaft 3*a*. The more the wear is, the greater the eccentric centrifugal force X is. The longest moment arm is the eccentric length XL from the middle of the ceramic bearing 79 to the middle of the front support 43. The shortest moment arm is the radial force arm length PL. The radial force P causes a tilt between the axis of the inner rotor 7 and the axis of the composited stationary shaft 3*a*, which leads to a continuous deformation of the front support 43.

The strength of the containment shell 41 (refer to FIG. 1A together) made of the anti-corrosion material is reduced when the temperature rises, the deformation happens due to the rise of the pressure as well. Being subject to a reference line C as the center reference point of the rear shaft seat 413 of the containment shell 41, the rear shaft seat 413 is applied by a very small portion of the joint force, and the joint force is mainly applied on the front support 43. The containment shell 41 is designed to only resist the internal pressure of the pumping liquid.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A magnetic drive pump having a pump casing, an impeller, an inner rotor, a stationary shaft, a bracket, a casing liner and a containment shell; the pump casing made of cast iron or stainless steel being used for containing the impeller, which is for converting shaft power to hydraulic power; the casing liner installed on a wetting side inside the pump for isolating a corrosive fluid; the pump casing comprising a front support, an inlet, a volute, an outlet, a casing back flange and the casing liner;

the casing back flange positioned at a rear end of the pump casing and assembled to the bracket and the containment shell;

the front support formed in an inner space of the inlet to be integrated with each other into one piece, the front support extending axially to be a cantilever structure for supporting a stationary shaft mating with the inner rotor to drive the impeller; and the magnetic drive pump being characterized in that:

the front support includes two rib plates supporting the stationary shaft, a cone body and a front shaft seat, the front support extends axially toward the inside of the pump casing, the rib plates extend inward from an inner surface of the inlet of the pump casing and combine together at a center of an inner diameter, combining into a right angle structure where the two ribs are perpendicular to each other; the cone body is formed at the intersection of the two ribs plates and a center of the cone body corresponds to the center of the inner diameter of the inlet of the pump casing, the cone body extends inwardly towards a rear side of the pump casing; the front shaft seat is positioned at the rear end of the front support, the rib plates extend axially according to an axial length of the cone body and a width of the rib plates of the front support is gradually reduced to match with an outer diameter of the front shaft seat; the front shaft seat passes through a hub aperture of the impeller;

the stationary shaft is a composited stationary shaft, a shaft hold of the front shaft seat with a thread hole is not encapsulated with the casing liner, and the thread hole is used for fixing one of two screw parts, wherein the two screw parts are at both ends of a metal shaft of the composited stationary shaft, respectively; a surface of the front shaft seat is divided into two ring-shaped surfaces which are a tied surface and a sealing surface; a tied surface is pressed against and attached to a surface of a ceramic shaft sleeve for ensuring a supporting stiffness of the composited stationary shaft, and keep right compression ratio of a resin enclosure at the sealing surface;

the composited stationary shaft is a double-sided-supporting structure; a front end of the composited stationary shaft is supported by the front support of the pump casing and a rear end of the composited stationary shaft is supported by a rear shaft seat of the containment shell; the composited stationary shaft comprises the ceramic shaft sleeve, the metal shaft and a sealing nut;

the metal shaft passes through a sleeve central hole of the ceramic shaft sleeve; the screw part at one end of the metal shaft is fixed with a thread hole positioned at a center of the front shaft seat of the front support, the screw part at the other end of the metal shaft utilizes a tied nut to press against a rear surface of the ceramic shaft sleeve; so a front end surface of the ceramic shaft sleeve is tightly pressed against the tied surface and the sealing surface of the front shaft seat of the front support to form the composited stationary shaft with high stiffness;

the ceramic sleeve has a front surface pressed against the tied surface, and the sealing surface pressed against the front shaft seat of the front support to keep right compression ratio of the resin enclosure at the sealing surface; the rear surface of the ceramic shaft sleeve is pressed by the tied nut for ensuring the supporting stiffness of the composited stationary shaft; and the sealing nut is a cup-shaped cylindrical metal component which is covered with the resin enclosure; the sealing nut is fixed on the rear end of the metal shaft for sealing the composited stationary shaft up completely; the opening surface of the sealing nut is pressed against the rear surface of the ceramic shaft sleeve.

2. The magnetic drive pump according to claim 1, wherein the casing liner is made of fluoropolymer.

3. The magnetic drive pump according to claim 1, wherein the cone body has a cone curve surface forms a smooth curve surface with the hub plate, which is near the stationary shaft and in the vicinity of the blade leading edge with the concave design.

4. The magnetic drive pump according to claim 1, wherein the tied surface of the front shaft seat is not encapsulated, and the sealing surface of the front shaft seat is encapsulated with the casing liner.

5. The magnetic drive pump according to claim 2, wherein the fluoropolymer is copolymer of tetrafluoroethylene, perfluoroalkoxyethylene (PFA) or ethylene Tetrafluoroethylene (ETFE).

* * * * *